US006206472B1

(12) United States Patent
Waugh

(10) Patent No.: US 6,206,472 B1
(45) Date of Patent: Mar. 27, 2001

(54) TWO POSITION RECLINABLE WOODEN CHAIR

(76) Inventor: James L. Waugh, 2211 Guffey Rd., North Huntingdon, PA (US) 15642

( * ) Notice: Subject to any disclaimer, the term of this patent is extended or adjusted under 35 U.S.C. 154(b) by 0 days.

(21) Appl. No.: 09/321,379

(22) Filed: May 27, 1999

Related U.S. Application Data

(60) Provisional application No. 60/086,989, filed on May 28, 1998.

(51) Int. Cl.[7] ..... A47C 3/00
(52) U.S. Cl. ..... 297/325; 297/310
(58) Field of Search ..... 297/310, 325, 297/452.63, DIG. 7, 328, 452.18

(56) References Cited

U.S. PATENT DOCUMENTS

| | | | | |
|---|---|---|---|---|
| 134,850 | * | 1/1873 | Carlan | 297/310 |
| 234,537 | * | 11/1880 | Clough | 297/310 |
| 375,840 | * | 1/1888 | Stockton | 297/310 X |
| 964,012 | * | 7/1910 | Folts | 297/325 X |
| 1,303,994 | * | 5/1919 | Ulman | 297/325 X |
| 1,525,726 | * | 2/1925 | Falconer | 297/310 |
| 2,104,830 | * | 1/1938 | Collard | 297/325 |
| 2,423,659 | * | 7/1947 | Rabe | 297/310 X |
| 3,848,883 | * | 11/1974 | Breacain | 297/310 X |
| 3,945,651 | * | 3/1976 | Boswinkel | 297/310 X |
| 4,469,377 | * | 9/1984 | O'Rourke | 297/310 X |
| 5,110,183 | * | 5/1992 | Jeanes, III | 297/325 X |
| 5,490,715 | * | 2/1996 | Opsvik | 297/310 |

FOREIGN PATENT DOCUMENTS

| | | | | |
|---|---|---|---|---|
| 270208 | * | 8/1950 | (CH) | 297/325 |
| 1176210 | * | 11/1958 | (FR) | 297/325 |

* cited by examiner

*Primary Examiner*—Peter M. Cuomo
*Assistant Examiner*—Stephen Vu
(74) *Attorney, Agent, or Firm*—Nils H. Ljungman & Associates

(57) ABSTRACT

A simplified reclining mechanism, as for chairs and seating, is herein described. The balanced design of such a reclinable chair for yard or patio usage is herein described. The reclining mechanism is an integral part of the chair or seat. The contoured design of the seat, back, legs and headrest gives firm, comfortable support to all parts of the body in both positions. What makes this chair stand above the rest is its unique 2 position balanced design. In the upright position it functions as a chair with head and legrest. Balance is the key to this design. By slightly throwing or shifting your weight backwards, this chair teters, giving a feeling of weightlessness and falling backwards until it lands solidly on its rear legs. In this position, every part of the occupant's body is cradled by the design. This chair also has the health advantage of having your legs lifted and held at heart level. A ¾" Indoor/Outdoor cloth covered foam pad or other appropriate covering can be added as an option for extra comfort.

8 Claims, 2 Drawing Sheets

✡=occupant center of gravity in each position

✡=occupant center of gravity in each position

TWO POSITION RECLINABLE WOODEN CHAIR

This application claim benefit to provisional application 60/086,989 May 28, 1998.

BACKGROUND OF THE INVENTION

1. Field of the Invention

The present invention relates particularly to reclining mechanisms for chairs and seating for both indoor and outdoor use.

2. Background Information

Prior to the present invention, reclinable types of chairs were usually equipped with a movable joint located at the union of the seat with the back, thus permitting the back to be inclined rearwardly. They usually consisted of an interlocking system composed of notches that permit the back to be placed in a certain set number of positions, generally from four to eight. However, this kind of mechanism is generally complicated, costly and susceptible to wear, corrosion fatigue and failure causing injury to the user. These chairs also normally had to have a thick, awkward cushion on them to be comfortable. Prior reclinable armchairs, having a number of positions for inclination, were usually of heavy steel and equipped with a series of spring and counterweights which made them heavy, complicated and costly. U.S. Pat. No. 3,870,364 discloses a more complicated padded upholstered arm chair with an internal reclining apparatus having a metal base frame pivotably mounted to a seat frame, at or near the front of the seat frame. The very old wooden designs, for example, U.S. Pat. No. 1,525,726, were typically just straight legged wooden chairs that tilted back only about 20–25°. Because of their high center of gravity and straight line design, they were very unstable and unsafe in the tilt back position.

OBJECT OF THE INVENTION

An object of the present invention is to make a reclining chair that is balance designed. Another object of the present invention is to make such a chair inexpensive and simple. Another object of the present invention is to make a reclining chair that rests firmly and securely (safely) in both the upright and reclined positions. Any other object of this invention will be apparent from the following descriptions. Furthermore, this invention has the health advantage of lifting the occupant's legs to the level of the heart for increased circulation to the legs and feet. A major advantage of the present invention lies in the comfortable contour of the seat, back and location of the headrest for body support.

SUMMARY OF THE INVENTION

A simplified and inexpensive, 2 position reclining chair, for example, a wooden lawn and patio chair is herein described. The balanced contoured design with no moving parts is an integral part of the chair or seat. The low center of gravity and the placement of the balance pivotal point allows the chair to set firmly in both the upright and reclined positions.

In the upright position, the chair can sit on a flat spot at the bottom of each of the center pivotal legs. This flat spot can be approximately 2" in length. The weight and balance of the chair combined with occupant's weight, sitting just ahead of a front pivot point, can hold the chair firmly in the upright position, supported by the center pivotal legs and the front legs of the chair. That is to say, in the upright position, the occupant's center of gravity can be located toward the center of the chair, at a point forward from a front pivot point on the chair. This can allow the inventive chair to move easily from the sitting to the reclining position under the influence of the occupant shifting or slightly throwing his or her weight backwards, thereby pivoting, or rocking, the chair along a pivot point or area into a reclined position. In at least one embodiment, the occupant can also push their feet against the ground to also exert a force in the backward direction to thus aid in the pivoting of the chair.

In at least one embodiment, a possible degree of angling of the seat arms is also possible, wherein the chair back and arms can have, for example, a comfortable 5° of lean backwards so the chair does not feel stiff or uncomfortable. However, this angle of lean may be different. Further, it is within the scope of the invention that various lengths, widths and heights of the chair can vary, depending upon a variety of variables, for example, the height or weight of the individual or child for which the chair is designed.

In at least one embodiment, in the reclined position the chair can sit on another flat or substantially flat spot at the bottom of each of the center pivotal legs, as well as two back legs. The chair can be extremely steady in this position, and almost impossible for the occupant to tip. The occupant's approximate position and center of gravity can shift backwards from the upright position, wherein the occupant's center of gravity can be lowered and occupant's weight can sit essentially just behind a back pivot point. To bring the chair back to the upright position, essentially all the occupant has to do is bend and lean forward, shifting his or her weight forward, and the chair will pivot back to the upright position because of the redistribution of weight.

In another possible embodiment of the present invention, the inventive chair can be designed to accommodate more than one person. This can be accomplished, for example, by varying the width of the chair. The chair would then be operated in essentially the same manner, however, some coordination between the occupants would facilitate the reclining and uprighting of the chair.

A possible degree angle of the seat arms is also possible in the reclined position. For example, the arm of the chair may be reclined to an approximate 40° angle if, in the upright position, the chair and arms has an approximate 5° lean backwards. However, this angle may vary if, for example, the angle of the chair and arms are different in the upright position.

In one possible embodiment of the chair, the chair can be constructed of wooden board slats in the seating area and have arm rests with triangular arm block supports. The length of board slats in the seating area can vary, depending upon the desired overall size of the chair, or the number of persons it is configured to seat. The widths of the slats can also vary, but should be of a dimension sufficient to provide both adequate support and comfort to the user. That is to say, the slats must be wide enough to support the weight of the user, but narrow enough to allow the shape of the chair to be contoured, to provide a more comfortable seating area for the chair's occupant or occupants.

In one embodiment of the center/back support leg, or legs (i.e., the center pivotal legs), of the reclined chair, the center/back support legs can be made of any resistant material for durability and strength, ¾" thick wolminized wood for example. The overall length, width, bottom flat spot and various cut degree angles for this center/back support leg can vary. This leg can also have a metal wear guard on the bottom to give added protection to the wood.

In at least one embodiment a rear leg, or legs, of the chair in the seated or upright position can be made of any resistant material for durability and strength, ¾" thick wolminized wood for example. Possible overall length, width and cut degree angles can vary.

The front leg, or legs, can also be made of ¾" wolminized wood for durability and strength, or any other resistant material, and their lengths and widths can also vary.

In one possible embodiment, the arms of the chair, may be made of ¾" white pine. White pine may be used because it comes into contact with the occupant of the chair. Wolminized wood can have arsenic and other harsh chemicals as a preservative that can be health hazards, thereby making it less desirable for an arm rest. However, any other non hazardous material may be used. Length, width and various other angles of this piece may also vary.

In at least one embodiments slats are used along the seat and back of the chair. These slats are securely attached in place, for example, by being nailed into the chair. These slats may be made of any non hazardous material, such as ¾" white pine for example, because they also can come into contact with the occupant's skin. In one possible embodiment, the seat and back may be composed of sixteen 20"×1.5" slats, a headrest may be composed of three 18.5"×1.5" slats and a legrest may be composed of seven 20"×2.⅜" slats which can be attached to the front of the front legs of the chair. However, the quantity, length and sizes above-cited may vary. Armrest supports may have a triangular shape and be screwed into the legs, however, their dimensions and shapes may also vary, as well as the materials used. For example, a plastic material could also possibly be used with at least one embodiment.

The chair can be assembled using a variety of known construction techniques and hardware, including, nuts, bolts, washers, screws, nails, etc.. For example, the legs could be bolted into position.

The above discussed embodiments of the present invention will be described hereinbelow with reference to the accompanying figures. When the word "invention" is used in this specification, the word "invention" includes "inventions", that is the plural of "invention". By stating "invention", the Applicant does not in any way admit that the present application does not include more than one patentability and non-obviously distinct invention, and maintain that this application may include more than one patentability and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Embodiments of the present invention will be described below with reference to the accompanying figures, wherein.

DESCRIPTION OF THE PREFERRED EMBODIMENTS

Figure 1:
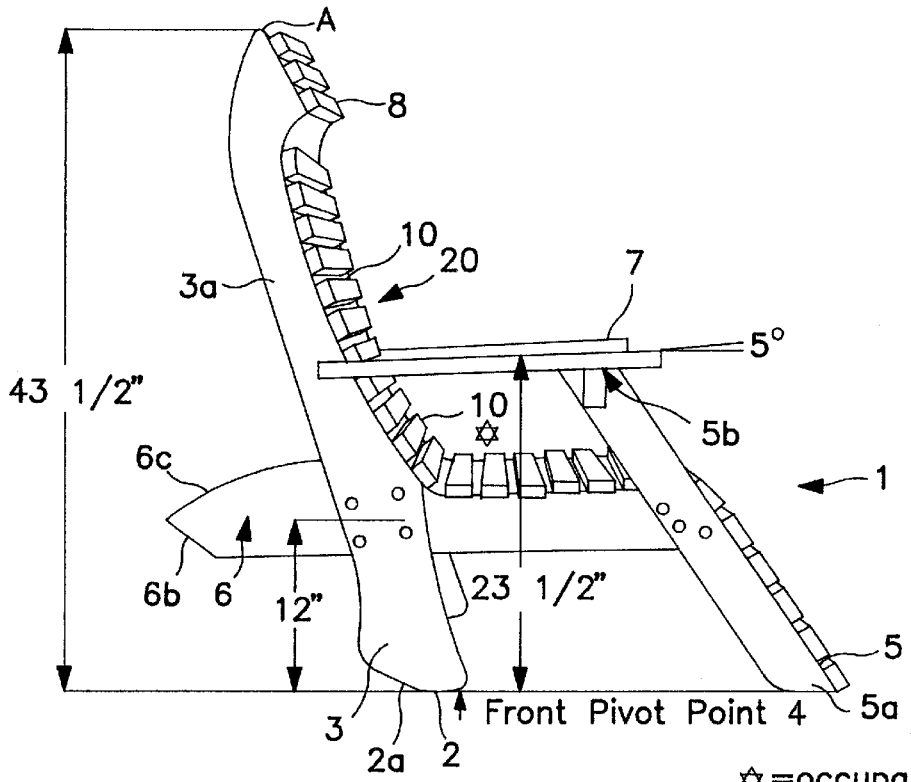
FIG. 1 is a side view of a reclinable chair made in accordance with this invention.
Figure 2:
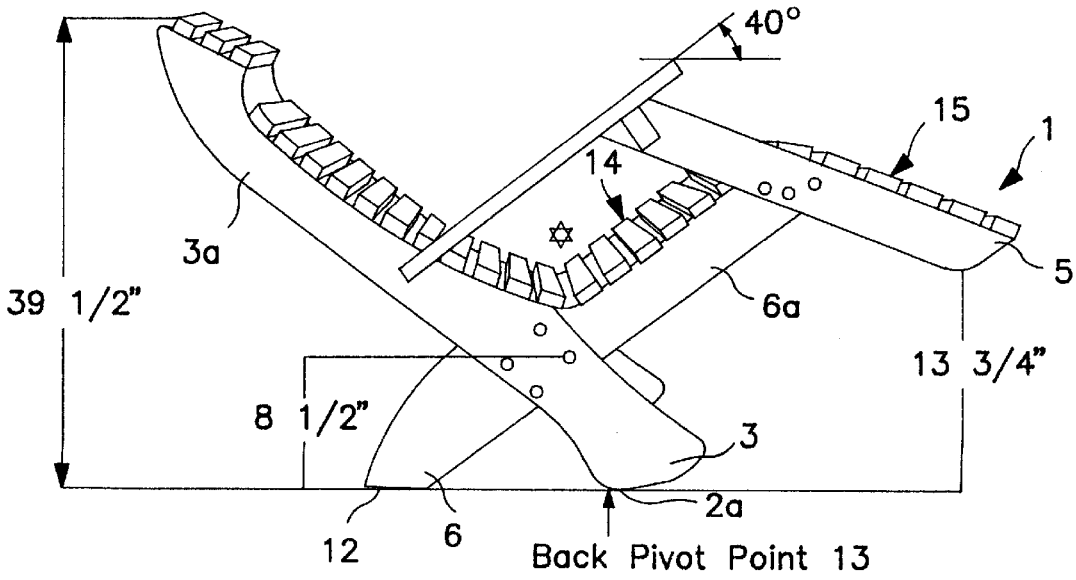
FIG. 2 is also a side view of chair in the reclined position.

FIGS. 1 and 2 are both side views of one embodiment of the reclining chair 1 made in accordance with this invention.

FIG. 1 is shows one embodiment of the reclining chair 1 in the upright position. FIGS. 13 and 21 also show at least one embodiment of the invention in the same position. In this state the chair can sit on a 2" flat spot 2 at the bottom of each of the center pivotal legs 3 (Front pivot point is indicated). The balance and weight of the chair, combined with occupant's weight, sitting just ahead of the front pivot point 4, holds the chair firmly in the upright position. A star indicates the occupant's approximate position and center of gravity. The chair 1 herein described moves easily from the sitting to the reclining position under the influence of the occupant shifting or slightly throwing his or her weight backwards.

A possible degree angle of seat arms 7 is also indicated in this state. The chair 1 and arms 7 have a comfortable approximately 5° of lean backwards, in comparison to the surface on which it sits, so the chair does not feel stiff or uncomfortable. However, the angle may be different.

Possible length and height of the chair 1, in accordance with one embodiment of the invention, are also indicated, but may vary. As shown in FIG. 1, in the upright position the chair can have a height of approximately 43½", as measured from the bottom of the center leg 3 to the top 8*a* of the headrest portion 8. The center legs 3 extend upward to form the outer sides, or frame structure, 3*a* of the chair 1, to which slats 10 can be attached across the width of the chair, to form a back rest portion 20. The arms 7, at the approximate center, can be positioned approximately 23½" from the floor.

In at least one embodiment, the back legs 6 can also extend to form a bottom seat frame or structure 6*a,* to which slats can also be attached. The back legs 6 can be firmly bolted to the center legs 3, in a substantially transverse direction, as shown in the figures. At the front of the seat area 14 (see FIG. 2) the front legs 5 can be firmly attached to one end of the rear legs 6, and these front legs 5 can be positioned at an angle of about 120° relative to the seat area 14 (see FIG. 1A). Additional slats 10 can be attached across the front 5*a* of the front legs 5 to form a legrest 15. This angling of the legrest 15 can provide not only comfort, but also, combined with the weight of the materials, aids in the correct balancing of the chair 1, and thus the ease in which the chair securely sits and operates. Similarly, in one embodiment, the back portion 20 can form an angle of about 120° with the seat portion 14, thereby aiding in the proper positioning of the center of gravity of the occupant, and the balancing of the chair's own weight, to thereby aid in the operation of the chair, as well as adding comfort for the occupant.

Figure 1A:
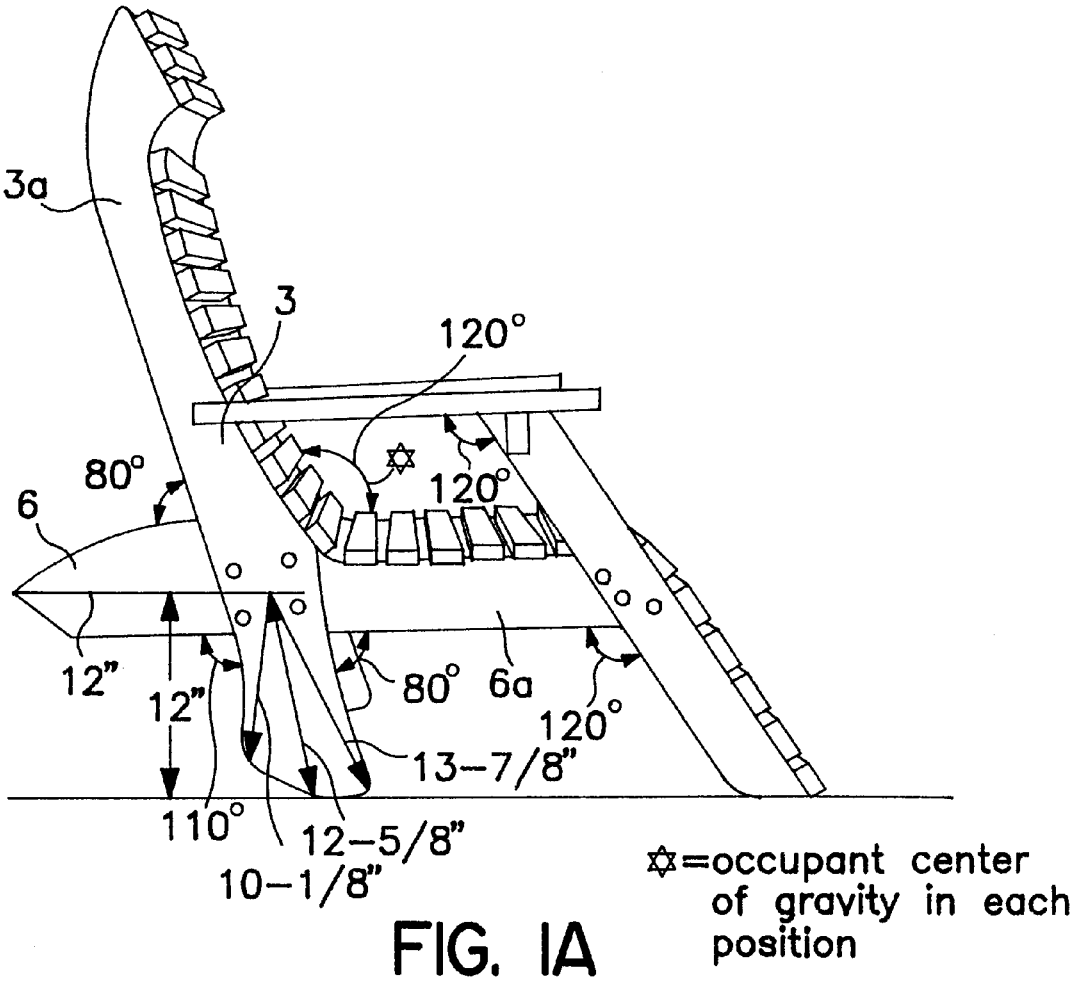
FIG. 1A is similar to FIG. 1 with additional possible dimensions.

FIG. 1A also lists additional angles that can be used with at least one embodiment of the invention, when constructing and assembling the different parts of the chair. These angles can also aid the proper balancing and functioning of at least one embodiment of the chair. For example, the center leg 3 and the back leg 6 can have an angle of approximately 110° between them, the center leg 3 can form an angle of approximately 80° with portion 6*a* of the back leg 6. An approximate 80° angle can be formed between the back leg 6 and the back frame portion 3*a* of leg 3.

FIG. 1A also indicates additional possible measurements for the bottom leg portion of the center leg 3, wherein the leg can have the indicated measurements. That is, in one possible embodiment, if the back leg 6 is measured from a substantially central connecting point, approximately 12" from the ground, and indicated by the letter "C", where the two leg portions 3, 6 are attached, the back can have an approximate 12" measurement, as indicated. If the center leg is measured from the center connecting point C to the front tip of the front pivot point, or pivot area 4, a length of about 13⅞" can be used. A measurement of about 10⅛" can extend from point C to the end of the back pivot point or area 13, and a length of about 12⅝" can extend from point C to a center area of the center leg. The ratio of these lengths, one to another, as well as the angles between the legs, can help in the proper functioning of the chair.

FIG. 2 shows one embodiment of the reclining chair 1 in the reclined position, and FIG. 14 shows pictures of one embodiment of the invention in the same position. In this state the chair 1 sits on a substantially flat spot 2*a* at the bottom of each of the center pivotal legs 3 (back pivot point is indicated). In one embodiment this substantially flat spot 2*a* can have a slightly convex curve shape across at least a portion of its length. Additionally, it is possible that a metal strip, or wear guard, can be fastened to the bottom of the center pivotal legs 3, to help protect the legs 3 from wear (see FIG. 27). In the reclined position the chair 1 is essentially rock steady and virtually impossible for the occupant to accidentally tip. A star indicates the occupant's approximate position and center of gravity. The occupant's center of gravity is lowered with occupant's weight sitting just behind the back pivot point 13. To bring the chair back to the upright position, essentially all the occupant has to do is bend and lean forward, shifting their weight forward, and the chair 1 will pivot back to the upright position.

A possible degree angle of the seat 14 and arms 7 is also indicated: in this position, the arms 7 of the chair may be reclined to a 40° angle if, in the upright position, the chair and arms have a 5° lean backwards. However, this angle may vary if, for example, the angle of the chair 1 and arms 7 are different in the upright position.

Possible length and height of the chair are also indicated, but may vary.

Any additional required assembly of the chair not described herein can be accomplished by well-known construction techniques known to those skilled in the art. Additionally, a ¾" Indoor/Outdoor cloth covered foam pad or other appropriate covering can be added as an option for extra comfort.

It is also within the scope of the present invention to construct at least one embodiment of the present inventive chair 1 from plastic resin. For example, a one-piece molded construction of the balanced design chair from plastic resin or any other man-made material capable of being molded into the inventive design.

Embodiments of the present invention are not limited to the indicated lengths, width, height and angles cited above, but may have other ranges that are appropriate, using other materials than those above-cited and/or under other conditions.

One feature of the present invention resides broadly in a substantially fully-reclining chair comprising six legs.

Another feature of the invention resides broadly in two legs that are the front legs in the upright position.

Yet another feature of the invention resides broadly in two center legs that constitute the pivot point of the reclining chair; the legs are the back legs of the chair in the upright position and the front legs in the reclined position.

Still another feature of the invention resides broadly in two legs that are the back legs in the reclined position.

Another feature of the invention resides broadly in the method of holding the chair firmly in both positions, comprising: in the upright position, the chair sits on a flat spot at the bottom of each of the center pivotal legs; this, combined with the occupant's weight sitting just ahead of the front pivot point holds the chair firmly in the upright position.

Yet another feature of the invention resides broadly in the chair wherein in the reclined position, the chair sits on a flat spot at the bottom of each of the center pivotal legs. It is essentially rock steady and virtually impossible for the occupant to tip; the occupant's center of gravity is lowered with occupant's weight sitting just behind the back pivot point.

Still another feature of the invention resides broadly in the reclining mechanism of said chair, comprising: two center legs that constitute the pivot point of the reclining chair, such as described herein.

Another feature of the invention resides broadly in a two position reclinable chair, said chair comprising: a seat member having a front end and a rear end; a back member attached to said rear end of said seat member and extending upwardly therefrom; a plurality of legs for supporting said seat member and said back member; said plurality of legs comprising: two front legs disposed to support said front end of said seat member; two back legs disposed to support said rear end of said seat member; and two center legs disposed between said two front legs and said two back legs; said chair having a stable upright position, a stable reclined position, and an unstable position therebetween; said two front legs and said two center legs being configured to contact a surface upon which the chair rests upon the chair being in said upright position; said two center legs and said two back legs being configured to contact a surface upon which the chair rests upon the chair being in said reclined position; said center legs being configured and disposed to provide a first pivot area to permit an occupant of the chair to shift his or her weight in a direction toward said back member, and thus to pivot said chair from said upright position to said reclined position; and said center legs also being configured and disposed to provide a second pivot area to permit the occupant to shift his or her weight in a direction toward said front end of said seat member, and thus to pivot said chair from said reclined position to said upright position.

Yet another feature of the invention resides broadly in the method of moving the chair from the sitting to the reclining position under the influence of the occupant shifting or slightly throwing their weight backwards.

Another feature of the invention resides broadly in the method of bringing the chair back to the upright position by bending and leaning forward.

A further feature of the invention resides broadly in the unique balanced design of said reclining chair which makes it different and unique from other types of known reclining chairs.

An additional feature of the invention resides broadly in that the chair is extremely steady in both positions due to the leg configuration, material used to assemble and the low center of gravity in either the upright or reclined position.

The components disclosed in the various publications, disclosed or incorporated by reference herein, may be used in the embodiments of the present invention, as well as, equivalents thereof.

The appended drawings and pictures in their entirety, including all dimensions, proportions and/or shapes in at least one embodiment of the invention, are accurate and to scale and are hereby included by reference to this specification.

All, or substantially all, of the components and methods of the various embodiments may be used with at least one embodiment or all of the embodiments, if more than one embodiment is described herein.

The following U.S. Patents, and any documents cited in any of the documents cited herein, are hereby incorporated by reference as if set forth in their entirety herein: No. 134,850, issued Jan. 14, 1873 to B. A. Carlan, entitled "Tip-Chairs"; No. 375,840, issued Jan. 3, 1888 to J. I. Stockton, entitled "Reclining attachment for chairs"; No. 1,525,726, issued Feb. 10, 1925 to W. M. Falconer, entitled "Chair"; No. 2,280,732, issued Apr. 21, 1942 to M. Thum, entitled "Convertible Rocking Chair"; No. 3,870,364, issued Mar. 11, 1975 to Cortina O., entitled "Reclinable chairs and seats"; No. 4,469,377 issued Sep. 4, 1984 to O'Rourke, entitled "Patient-restraining strapless seat".

The following U.S. Patents may contain examples of a reclining chair/seat: No. 1,960,022; No. 2,027,125; No. 2,141,475; No. 2,241,115; No. 2,591,911; No. 2,763,319; No. 3,195,954; No. 3,645,548; No. 3,695,702; No. 4,049,314; No. 4,222,740; No. 4,230,364

All of the patents, patent applications and publications recited herein, and in the Declaration attached hereto, are hereby incorporated by reference as if set forth in their entirety herein.

The details in the patents, patent applications and publications may be considered to be incorporable, at the applicant's option, into the claims during prosecution as further limitations in the claims to patentably distinguish any amended claims from any applied prior art.

Those skilled in the art will readily appreciate that many modifications are possible in the exemplary embodiments described above without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention described hereinabove is not to be taken as limited to all of the provided details thereof, since modifications and variations thereof may be made without departing from the spirit and the scope of the invention.

What is claimed:

1. A two position reclinable chair comprising:

a seat member having a front end and a rear end;

a back member attached to said rear end of said seat member and extending upwardly therefrom;

a plurality of legs for supporting said seat member and said back member;

said plurality of legs comprising:

two front legs disposed to support said front end of said seat member;

two back legs disposed to support said rear end of said seat member; and two center legs disposed between said two front legs and said two back legs;

said chair having a stable upright position, a stable reclined position, and an unstable position therebetween;

said two front legs and said two center legs being configured to contact a surface upon which the chair rests upon the chair being in said upright position;

said two center legs and said two back legs being configured to contact a surface upon which the chair rests upon the chair being in said reclined position;

said center legs being configured and disposed to provide a first pivot area to permit a chair user of the chair to shift his or her weight in a direction toward said back member, and thus to pivot said chair from said upright position to said reclined position;

said center legs being configured and disposed to provide a second pivot area to permit the chair user to shift his or her weight in a direction toward said front end of said seat member, and thus to pivot said chair from said reclined position to said upright position;

wherein said two center legs each comprise a first end and a second end disposed opposite to one another and a central area disposed therebetween;

said first end being configured to contact the surface upon which the chair sits;

said second end comprises a portion configured to support the head of a chair user of the chair;

said central area comprising a portion configured and disposed to provide support to the back of a chair user of said chair;

each of said first ends comprise a first substantially flat surface, and a second substantially flat surface;

said first surface and said second surface being disposed to form an obtuse angle therebetween;

said first surface being disposed to contact the surface upon which said chair rests upon said chair being in said upright position, and at least a portion of said second surface being disposed to contact the surface upon which the chair rests upon said chair being in the reclined position;

at least a portion of said first surface forming said first pivot area and at least a portion of said second surface forming said second pivot area;

said back legs each comprise an end portion and a front portion and a center portion disposed therebetween;

said front portion comprises a seat area;

said center portion being attached to said central area of a corresponding one of said center legs;

said center legs and said back legs being disposed substantially transverse to one another;

each of said end portions of said back legs comprise a surface area to contact the surface upon which the chair rests upon said chair being in said reclined position;

said back leg surface area and said second surface of said center leg are substantially aligned with one another to thus provide in combination a stable resting surface for said chair in said reclined position;

said two front legs each comprise a first end portion and a second end portion disposed opposite to one another, and a central portion disposed therebetween;

said second end portion of each of said two front legs being configured and disposed to contact the surface upon which the chair rests upon the chair being in the upright position;

said front portions of said back legs each comprising a front end portion;

each of said central portions of said two front legs being connected to a corresponding one of said front end portions of said back legs;

said front legs being disposed substantially transverse to said back legs, wherein said front legs and said front portion of said back legs form an obtuse angle with one another in a downward direction and an acute angle with one another in an upward direction to minimize instability of said chair in the upright position;

said second substantially flat surfaces of said first ends of said center legs have a slightly convex shape;

said chair comprises two arm members;

said two arm members are disposed substantially parallel to said back legs;

said two arm members each have a first end and a second end disposed opposite to one another;

each of said first ends of said arm members being attached to a corresponding one of said back supporting portions of said two center legs;

each of said second ends of said arm members being attached to a corresponding one of said first end portions of said two front legs;

said front legs each comprise a front surface facing away from said center legs and a back surface facing toward said center legs;

each of said arm members forming an obtuse angle with a corresponding one of said back surfaces of said two front legs; and said central area of said two center legs being disposed to lean in a backward direction to thus form an obtuse angle with said front portions of each of said back legs and an acute angle with said end portion of each of said back legs.

2. The reclinable chair according to claim 1, comprising:

a plurality of slat members;

each said seat area of said back legs comprises a contoured upper edge surface;

a first portion of said plurality of slat members being disposed along said contoured upper edge surface to connect said seat areas of each of said two back legs to thus form at least a portion of said seat member;

said center area of each of said two center legs comprises a contoured edge area;

a second portion of said plurality of slat members being disposed along said contoured edge areas to thus connect at least a portion of said center areas of each of said two center legs to one another to thus form at least a portion of said back member;

said second end of said center legs comprises a bent portion and an end surface;

a third portion of said plurality of slat members being disposed to connect said bent portions and said end surfaces of each of said second ends of said two center legs to one another to thus form a headrest member;

a fourth portion of said slat member being disposed to connect said front surfaces of said two front legs to one another to form a legrest member.

3. The reclinable chair according to claim 2, wherein an occupant of the chair has a center of gravity, said chair further comprises:

an extreme front portion and an extreme back portion;

said seat member and said back member being configured and disposed to position the center of gravity of a chair user of said chair substantially at a first location upon the chair being in said upright position, and substantially at a second location upon said chair being in said reclined position;

said first location is disposed relative to said first pivot area at a position closer to said extreme front portion than said front pivot to thus stabilize said chair in said upright position; and said second location is disposed relative to said second pivot area at a position closer to said extreme back portion than said second pivot area to thus stabilize said chair in the reclined position.

4. The reclinable chair according to claim 3, wherein:

each said first ends of said center legs being disposed to form in a downward direction an obtuse angle with a corresponding end portion of said back legs; and each said first ends of said center legs being disposed to form in a downward direction an acute angle with a corresponding front portion of said back legs.

5. The method of using a two position reclinable chair, said chair comprising: a seat member having a front end and a rear end; a back member attached to said rear end of said seat member and extending upwardly therefrom; a plurality of legs for supporting said seat member and said back member; said plurality of legs comprising: two front legs disposed to support said front end of said seat member; two back legs disposed to support said rear end of said seat member; and two center legs disposed between said two front legs and said two back legs; said chair having a stable upright position, a stable reclined position, and an unstable position therebetween; said two front legs and said two center legs being configured to contact a surface upon which the chair rests upon the chair being in said upright position; said two center legs and said two back legs being configured to contact a surface upon which the chair rests upon the chair being in said reclined position; said center legs being configured and disposed to provide a first pivot area to permit a chair user of the chair to shift his or her weight in a direction toward said back member, and thus to pivot said chair from said upright position to said reclined position; said center legs being configured and disposed to provide a second pivot area to permit the chair user to shift his or her weight in a direction toward said front end of said seat member, and thus to pivot said chair from said reclined position to said upright position; said method comprising the steps of a chair user:

sitting down on the seat member of the chair;

shifting his or her weight in a direction toward the back member of the chair;

pivoting the chair on the first pivot area, from the upright position to the stable reclined position;

shifting his or her weight in a direction toward the front end of the seat member; and pivoting the chair on the second pivot area, from the reclined position to the stable upright position;

wherein a chair user of the chair has a center of gravity, said chair further comprises: an extreme front portion and an extreme back portion; said seat member and said back member being configured and disposed to position the center of gravity of a chair user of said chair substantially at a first location upon the chair being in said upright position, and substantially at a second location upon said chair being in said reclined position; said first location is disposed relative to said first pivot area at a position closer to said extreme front portion than said front pivot to thus stabilize said chair in said upright position; and said second location is disposed relative to said second pivot area at a position closer to said extreme back portion than said second pivot area to thus stabilize said chair in the reclined position; said method further comprises the steps of:

stabilizing said chair in the upright position, by the user disposing his or her center of gravity at a first location, said first location being disposed relative to said first pivot area at a position closer to said extreme front portion than said front pivot upon the chair being in said upright position, stabilizing said chair in said reclined position by the user disposing his or her center of gravity at a second location, said second location being disposed relative to said second pivot area at a position closer to said extreme back portion than said second pivot area, said two center legs each comprise a first end and a second end disposed opposite to one another and a central area disposed therebetween;

said first end being configured to contact the surface upon which the chair sits;

said second end comprises a portion configured to support the head of a chair user of the chair;

said central area comprising a portion configured and disposed to provide support to the back of a chair user of said chair;

each of said first ends comprises a first substantially flat surface, and a second substantially flat surface;

said first surface and said second surface being disposed to form an obtuse angle therebetween;

said first surface being disposed to contact the surface upon which said chair rests upon said chair being in said upright position, and at least a portion of said second surface being disposed to contact the surface upon which the chair rests upon said chair being in the reclined position;

at least a portion of said first surface forming said first pivot area and at least a portion of said second surface forming said second pivot area;

said back legs each comprise an end portion and a front portion and a center portion disposed therebetween;

said front portion comprises a seat area;

said center portion being attached to said central area of a corresponding one of said center legs;

said center legs and said back legs being disposed substantially transverse to one another;

each of said end portions of said back legs comprise a surface area to contact the surface upon which the chair rests upon said chair being in said reclined position;

said back leg surface area and said second surface of said center leg are substantially aligned with one another to thus provide in combination a stable resting surface for said chair in said reclined position;

said two front legs each comprise a first end portion and a second end portion disposed opposite to one another, and a central portion disposed therebetween;

said second end portion of each of said two front legs being configured and disposed to contact the surface upon which the chair rests upon the chair in the upright position;

said front portions of said back legs each comprising a front end portion;

each of said central portions of said two front legs being connected to a corresponding one of said front end portions of said back legs;

said front legs being disposed substantially transverse to said back legs, wherein said front legs and said front portion of said back legs form an obtuse angle with one another in a downward direction and an acute angle with one another in an upward direction, to minimize the instability of the chair in the upright position;

said second substantially flat surfaces of said first ends of said center legs have a slightly convex shape;

said chair comprises two arm members;

said two arm members are disposed substantially parallel to said back legs;

said two arm members each have a first end and a second end disposed opposite to one another;

each of said first ends of said arm members being attached to a corresponding one of said back supporting portions of said two center legs;

each of said second ends of said arm members being attached to a corresponding one of said first end portions of said two front legs;

said front legs each comprise a front surface facing away from said center legs and a back surface facing toward said center legs;

each of said arm members forming an obtuse angle with a corresponding one of said back surfaces of said two front legs; and said central area of said two center legs being disposed to lean in a backward direction to thus form an obtuse angle with said front portions of each of said back legs and an acute angle with said end portion of each of said back legs.

6. The method according to claim 5, comprising:

a plurality of slat members;

each said seat area of said back legs comprises a contoured upper surface area;

a first portion of said plurality of slat members being disposed along said contoured upper surface areas to connect said seat areas of each of said two back legs to thus form at least a portion of said seat member;

said center area of each of said two center legs comprises a contoured edge area; and a second portion of said plurality of slat members being disposed along said contoured edge areas to thus connect at least a portion of said center area of each of said two center legs to one another to thus form at least a portion of said back member.

7. The method according to claim 6, wherein:

said second end of said center legs comprises a bent portion and an end surface;

a third portion of said plurality of slat members being disposed to connect said bent portions and said end surfaces of each of said second ends of said two center legs to one another to thus form a headrest member; and a fourth portion of said slat member being disposed to connect said front surfaces of said two front legs to one another to form a legrest member.

8. The method according to claim 7, wherein:

each said first ends of said center legs being disposed to form in a downward direction an obtuse angle with a corresponding end portion of said back legs; and each said first ends of said center legs being disposed to form in a downward direction an acute angle with said front portion of said back legs.

* * * * *